US005398590A

United States Patent [19]

Snyder, Sr.

[11] Patent Number: 5,398,590

[45] Date of Patent: Mar. 21, 1995

[54] SELF-POWERED AMMUNITION FEED AND STORAGE CANISTER

[75] Inventor: Ronald R. Snyder, Sr., Irvine, Calif.

[73] Assignee: Western Design Corporation, Irvine, Calif.

[21] Appl. No.: 13,717

[22] Filed: Feb. 3, 1993

[51] Int. Cl.[6] ..... F41A 9/79

[52] U.S. Cl. ..... 89/33.16; 89/33.02; 89/34

[58] Field of Search ..... 89/34, 33.14, 33.16, 89/33.17, 33.02, 33.1; 42/49.01

[56] References Cited

U.S. PATENT DOCUMENTS

| | | | |
|---|---|---|---|
| 1,314,013 | 8/1919 | Mulvey | 89/33.1 |
| 2,506,409 | 5/1950 | Baumwart | 89/34 |
| 3,974,739 | 8/1976 | Bourlet | 89/34 |
| 4,384,508 | 5/1983 | Sullivan et al. | 89/33.02 |
| 4,939,979 | 7/1990 | Capawana | 89/34 |
| 4,965,951 | 10/1990 | Miller et al. | 89/33.02 |

FOREIGN PATENT DOCUMENTS

| | | | |
|---|---|---|---|
| 80161 | 5/1919 | Austria | 89/33.02 |
| 234009 | 10/1963 | Austria | 89/34 |

*Primary Examiner*—Stephen M. Johnson
*Attorney, Agent, or Firm*—Walter A. Hackler

[57] ABSTRACT

An ammunition canister includes a pair of injection molded outer shells with each shell configured for assembly with another shell to form the ammunition canister. Each shell is molded with guide surfaces for controlling movement of ammunition rounds within the canister. An injection molded spring housing assembly, rotatably mounted to one of the shells, includes a spring for applying torque to said drive sprocket and a crank and ratchet are provided for tensioning the spring.

9 Claims, 4 Drawing Sheets

SELF-POWERED AMMUNITION FEED AND STORAGE CANISTER

The present invention generally relates to an ammunition canister and more specifically is directed to a lightweight canister which may be loaded with rounds at an ammunition facility with a built-in hermetic seal and little dunnage.

A great number of ammunition feed and storage systems have been designed in the gun industry which are specifically configured and limited to a certain extent in their versatility to a specific weapon.

In many instances, canisters and magazines handling a large amount of ammunition can encounter problems due to lack of ammunition control within the canister and gun power requirements necessary to forward feed the ammunition rounds from the canister.

Further, conventional ammunition canisters and magazines have been made from metal and/or wood and thus require a highly sophisticated work force and a large capital investment for tooling. In this regard, there are only a few facilities currently in production in the United States, which creates a user drawback and little opportunity for effective competition. In addition, because of these factors, it is difficult to rapidly expand production during times of surge production requirements.

In addition, typical ammunition systems include a conventional gun magazine utilized in separate wooden or metal containers to separately transport the ammunition and the magazines. Hence, the end user must transfer the ammunition from a shipping and storage container to a magazine. Additionally, if downloading is required, dunnage recovery may now become a problem.

A canister in accordance with the present invention overcomes the hereinabove-recited problems and provides a high ammunition density pre-loaded canister, utilizing recyclable plastic, and further provides power assistance to the gun for ejecting ammunition rounds from the canister, thereby reducing drag by the gun and ensuring proper firing rate for the gun.

SUMMARY OF THE INVENTION

An ammunition canister, in accordance with the present invention, generally includes an injection molded housing, which more specifically may include a pair of injection molded outer shells, with each shell configured for assembly with one another to form an ammunition canister. Each shell is also formed with guide surfaces for controlling movement of ammunition rounds within a canister.

In addition, an injection molded sprocket means, which includes a drive sprocket and an idler sprocket are provided for moving the ammunition rounds within the canister.

An injection molded spring housing assembly, rotatably mounted to one of the shells, enables a spring to apply a torque to the drive sprocket and crank means is provided for tension and spring, along with ratchet means for engaging the outer shell so that tension may be maintained on the sprocket.

Preferably, all of the components of the present invention, except for a spring and an O-ring (to be discussed later), are made of plastic. This has significant advantages in that the canister may be manufactured from non-strategic materials and a dedicated factory is neither required nor desired, since component molds can be inserted into general purpose molding machines.

As is well-known in the art, such machines are computer controlled and thus precision requirements can be met with a relatively low technical labor force. In addition, requirements for a large capital investment are significantly reduced and since the molds and the computer software are easily transportable, they can be shifted from one venue to another while maintaining quality, high production rates, and cost competitiveness.

In addition, when the canister is no longer serviceable, it may be recycled, further reducing the life cycle cost and, importantly, addressing current environmental considerations. The canister uses no dunnage for round separation and protection, as is used in conventional weapons, thus simplifying recovery.

Further, this design approach is applicable to essentially all types of linked or unlinked ammunition. And, with the exception of the spring and O-ring, the canister may be totally recycled and, in addition, because there is no dunnage required, there is no trash to dispose of or pick up after use. This feature is consistent with today's environmentally conscious population.

More specifically, the ammunition canister, in accordance with the present invention, may be injection molded from a plastic material having sufficient translucence to enable visual verification of a quantity of ammunition rounds disposed within the canister. In addition, the position of ammunition rounds within the canister may be verified and an operation status of the canister determined by the detection of jammed rounds or obstacles within the canister impeding proper canister operation.

Importantly, this translucency enhances the reloadability of the canister in the field. A user can easily determine the number of rounds required and ensure that the rounds inserted into the canister are properly rooted therein, along the guiding surfaces, thereby reducing chances of creating ammunition jamming within the canister during reloading.

More particularly, the driver and idler sprockets may be identical in size and shape. This feature enables a reduction in the number of molds necessary for the production of the subject canister.

Still more particularly, the canister in accordance with the present invention may include an injection molded, non-detachable cover and means enabling permanent assembly with the pair of injection molded outer'shells. The cover may be hinge mounted and have integrally molded thereinto latch means for engaging the shells in order to lock the cover over an ammunition exit port.

An injection molded latching pawl means may also be provided for preventing inadvertent ejection of ammunition rounds when the spring is tensioned and the cover is in an open position.

BRIEF DESCRIPTION OF INVENTION

Other features and advantages of the invention will appear from the claims and from the following description of certain embodiments of the invention, given by reference to the drawing which shows essential details of the invention, it being understood that the individual features may be implemented in any embodiment of the invention, individually or in any combination thereof.

Figure 3:
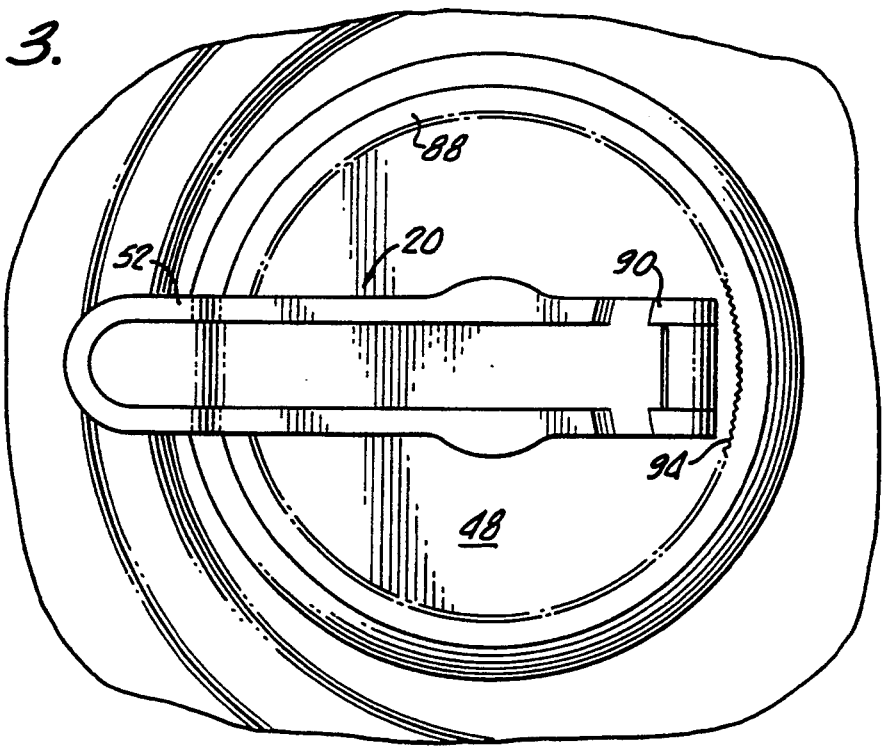
FIG. 3 is an enlarged view of the spring crank assembly in accordance with the present invention.
Figure 4:
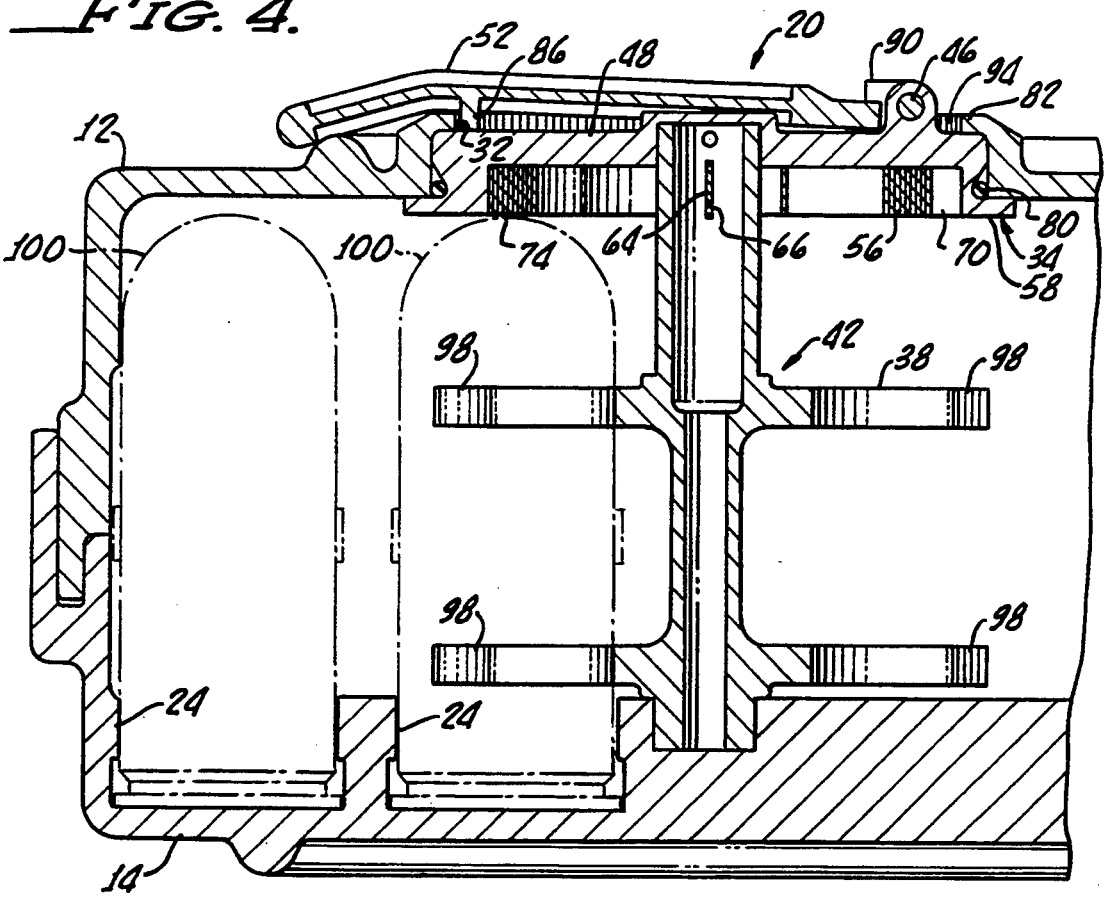
FIG. 4 is a cross-sectional view of the crank assembly shown in FIG. 3.
Figure 5:
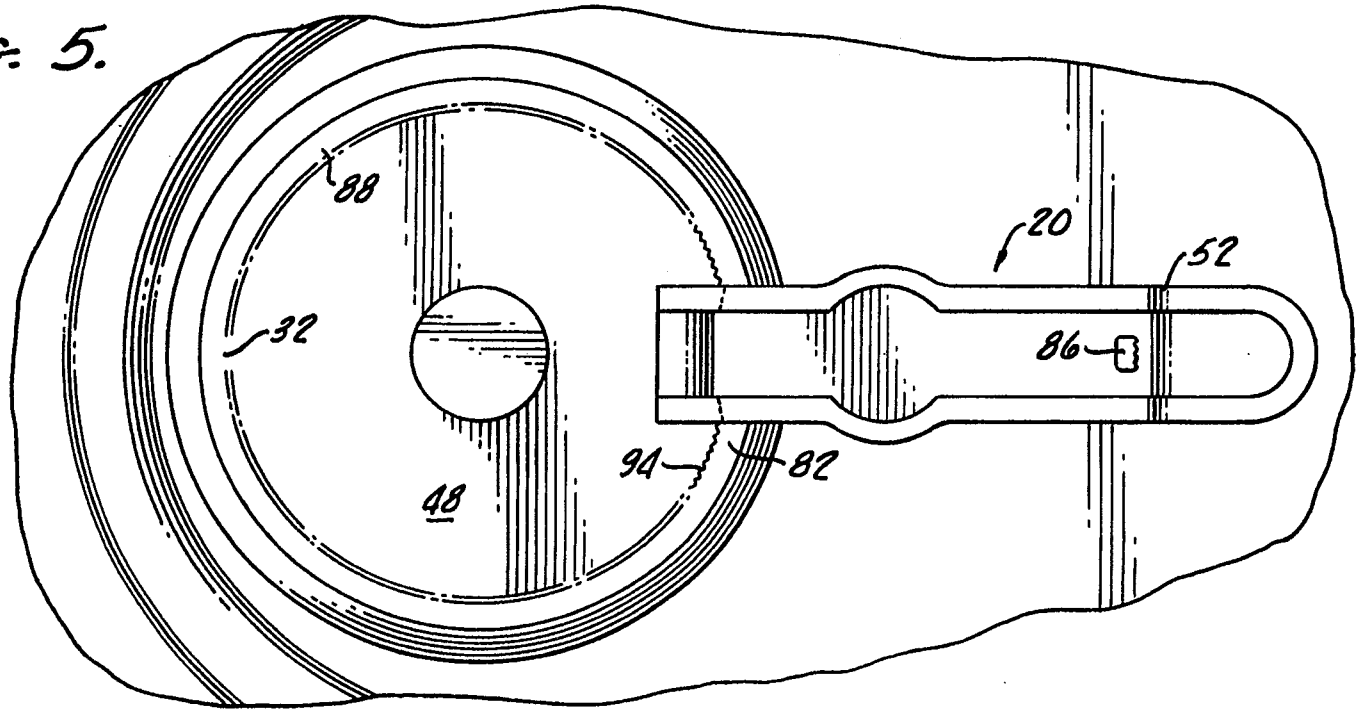
Figure 6:
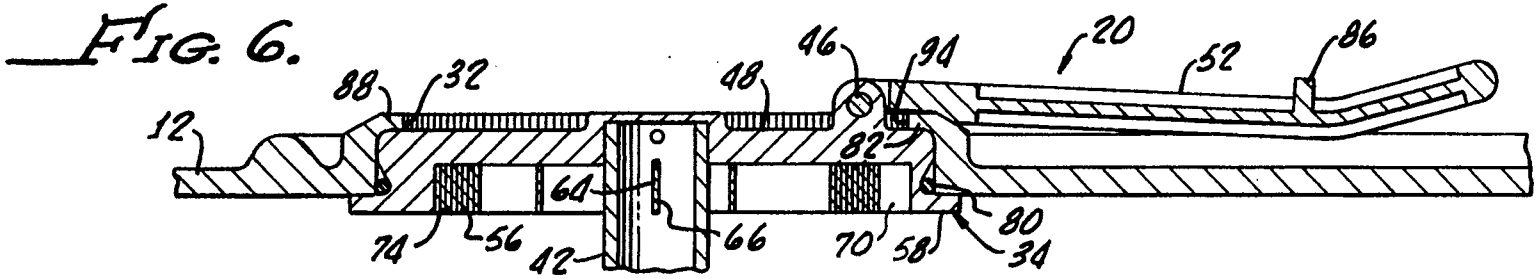

FIG. 5 a view similar to FIG. 3, showing the crank assembly in an open position;

FIG. 6 is a cross-sectional view of the crank assembly shown in FIG. 5; and

Figure 7:
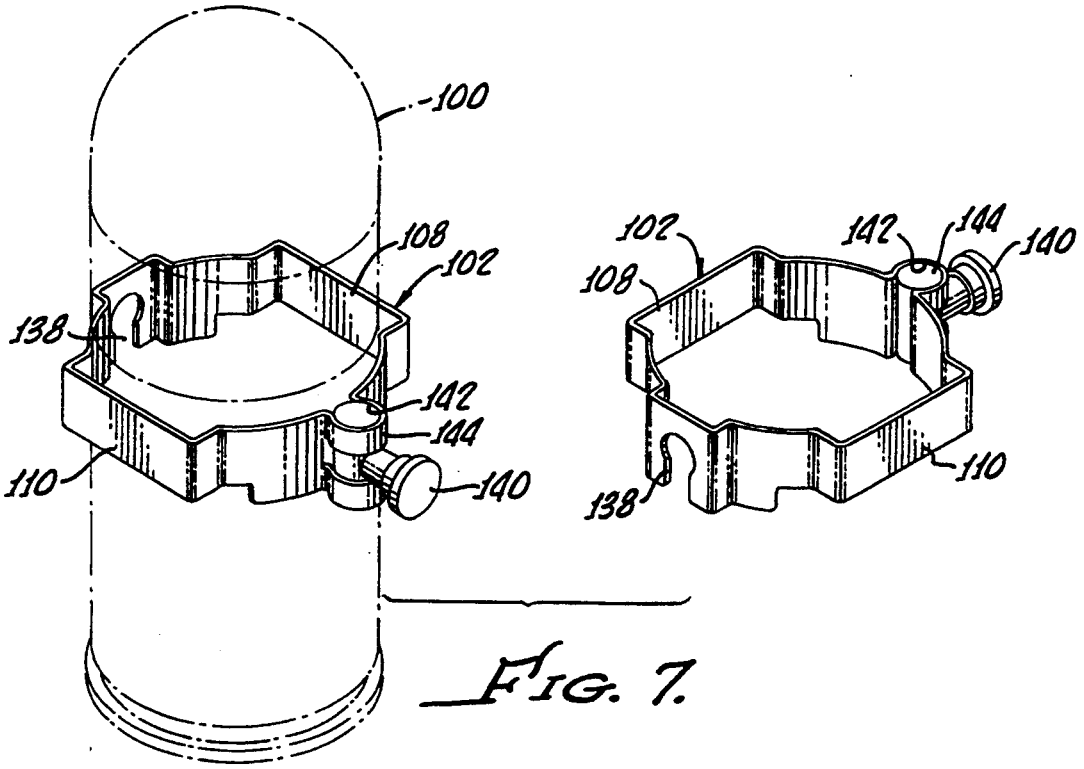

FIG. 7 is an enlarged exploded perspective view of ammunition carrier links in accordance with the present invention.

DETAILED DESCRIPTION

Figure 1:
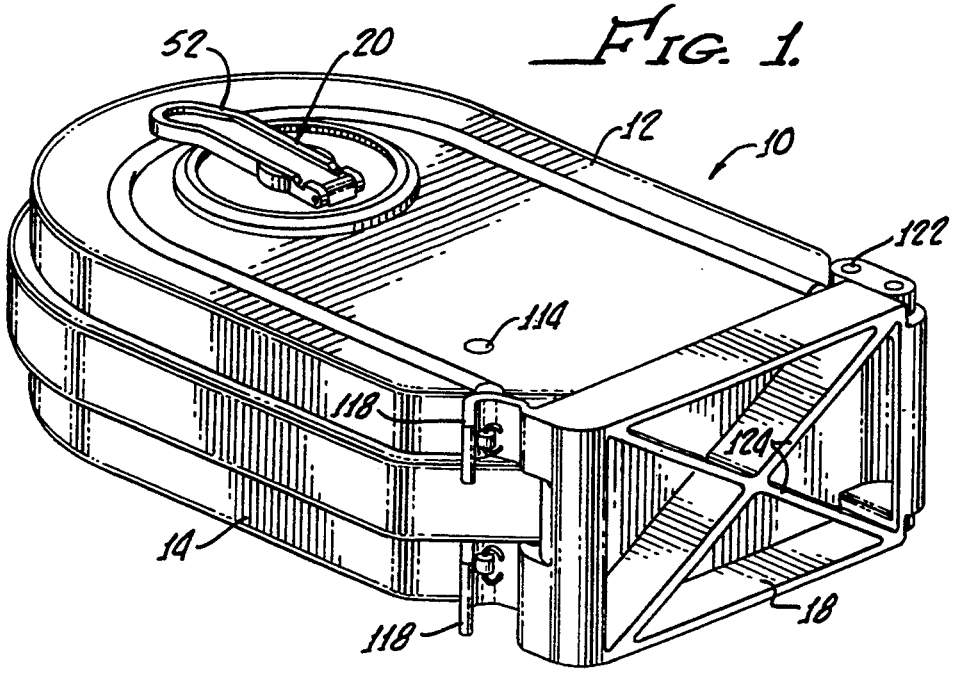
FIG. 1 is a perspective view of an ammunition canister in accordance with the present invention showing a pair of injected molded outer shells, a crank assembly designed for tensioning a spring within the housing (not shown in FIG. 1) and end cover.

Turning now to FIG. 1, there is shown an ammunition canister 10, in accordance with the present invention, which generally includes a pair of injection molded outer shells 12, 14 and end cover 18 along with a crank assembly 20. The shells 12, 14 are preferably injected molded with any suitable recyclable plastic, as hereinabove noted.

Figure 2:
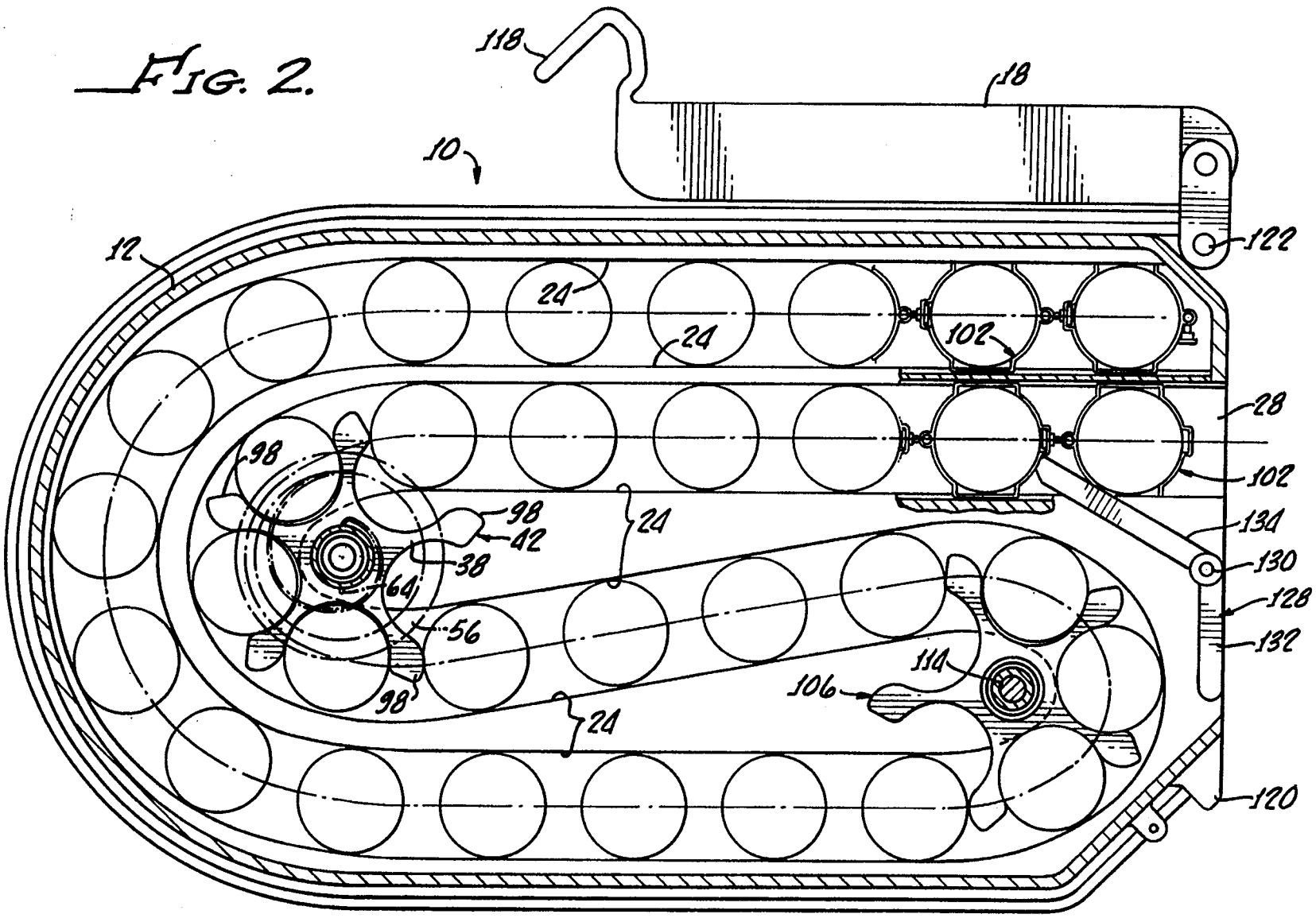
FIG. 2 is a plan cross-sectional view of the canister shown in FIG. 1 with the end cover in an opened position.

As shown in FIG. 2, integral to the shells 12, 14 are guide surfaces 24 for providing control of the ammunition (not shown in FIG. 2) movement through the canister 10 to an exit port 28.

As shown in FIGS. 3–6, the shell 12 includes an opening 32 molded thereinto for acceptance of the crank assembly 20. The crank assembly 20 includes a rotor 34 fitted to a top 38 of a sprocket 42 which is mounted for rotation between the shells 12, 14. Any conventional method may be utilized for joining the sprocket top 38 under rotor 34. Hinge 46 mounted to a top 48 of the rotor 34 is a crank handle 52 which is pivotable from a closed position, shown in FIGS. 3 and 4, to an open position, shown in FIGS. 5 and 6, the latter position enabling the tightening of a coil spring disposed on an underside 58 of the rotor 34. A spring 56 has one end 64 fixed to a sprocket top 38 by means of a slot 66 with another end 70 fixed to an inside surface 74 of the rotor 34.

The rotor 34 is rotatably mounted within the opening 32 and sealed therein by a means of an O-ring 80. Upon assembly of the shells 12, 14, together with the sprocket 42 therebetween, a lip 82 prevents separation of the rotor 34 from the shell 12.

The crank handle 52 may be held in the stowed position, as shown in FIG. 3, a depending member 86 engaging an opposite facing 88 formed adjacent the opening 32 in the shell 12.

In the open, or actuated, position shown in FIGS. 5 and 6, a fixed pawl surface 90 engages ratchet-like indentations 94 formed in the lip 82 to enable the of the crank handle 52 to be turned for rotating the rotor 34 and charging spring 56 and maintaining the spring charge by preventing rotation of the rotor 34 in an opposite direction.

The spring charge is transferred by sprocket arms 98 to ammunition rounds 100 via ammunition clips 102, as shown in FIG. 7. The drive sprocket 42 works in concert with an idler sprocket 106 for moving the ammunition 100 through the guide surfaces 24 molded into the shells 12, 14. Each ammunition clip includes outboard surfaces 108, 110 for slidably engaging the guide surfaces 24 to the smooth movement of the ammunition rounds within the canister and out through the exit port 28.

The idler sprocket 106 and the drive sprocket 42 may be injected molded from the same material as the shells 12, 14 and are preferably identical in size and shape, so that the same die may be used for each of the drive and idler sprockets 42, 106. This commonality of parts lowers the cost and simplifies the overall construction of the canister 10.

Idler sprocket 106 is mounted between the shells 12, 14 on assembly by means of holes 114 in the shells 12, 14.

It should be appreciated that the flat coil spring 56 is the only metallic item utilized in the canister 10 that may be of typical high carbon steel used for springs with corrosion protection provided through the use of conventional corrosion resistant sprays or by plating with a nickel, cadmium or other coating compatible for applications of this type.

It should also be appreciated that the canister 10, according to the present invention, enables the storage of ammunition rounds 100 and spring-assisted deployment of the rounds 100 without the necessity of maintaining the spring tension during storage. That is, ammunition rounds 100 may be fed into the canister 10 via the port 28 and immediately prior to the use of the canister, the spring 56 may be tensioned by rotation of the crank handle.

Ammunition rounds 100 are prevented from ejection through the port 28 by the injection molded, nondetachable cover 18, which is held in a closed position by means of outwardly projecting end tabs 118 which engage a holding surface 120 molded into the shells 12, 14, as shown in FIG. 1.

The cover may be molded from the same material as the shells and is attached thereto during assembly. The cover 18 is hinged by pins 122 molded into the shells 12, 14 which enable the lid 18 to be folded to an out-of-the-way position as shown in FIG. 2. The tabs 118 are sufficiently large to enable a user for admittance to open the lid from its latched position, as shown in FIG. 1, to the open position, as shown in FIG. 2. As shown, the lid includes molded reinforcement members 124 in the form of an X in order to reduce plastic volume and weight of the canister 10.

In order to prevent inadvertent ejection of the ammunition rounds 100 from the canister 10 when the lid is opened, an ejection-molded locking pawl 128 is pivotally mounted between the shells 12, 14 by means of a pin 130 or the like. A short leg 132 of the pawl 128 bears against the lid 18 when in a closed position, thus enabling a long leg 134 to engage an ammunition round and then movement thereof towards the lid.

After a spring 56 is wound, the drive sprocket 42 provides a bias of the ammunition rounds 100 and clips 102 against the long leg 134, preventing ejection of the ammunition rounds and clips from the exit 28 when the lid is in an open position, as shown in FIG. 2. The locking pawl 128 is released when the canister is inserted into a gun and a protruding member (not shown) of the gun urges the long leg 134 out of engagement with the ammunition round 100 and clip 102.

Turning again to FIG. 7, the clips 102 may be coupled to one another through a slot 138 and a coupler 140, pivotally mounted between molded openings 142, 144 in each clip 102.

Although there has been hereinabove described a self-powered ammunition feed and storage canister in accordance with the present invention, for the purpose of illustrating the manner in which the invention may be used to advantage, it should be appreciated that the invention is not limited thereto. Accordingly, any and all modifications, variations, or equivalent arrangements which may occur to those skilled in the art, should be considered to be within the scope of the present invention as defined in the appended claims.

What is claimed is:

1. An ammunition canister comprising:

a pair of plastic outer shells, molded from a sufficiently translucent plastic material to enable visual verification of a quantity of ammunition rounds disposed in the canister, each said shell configured for assembly with another shell to form an ammunition canister, each said shell being molded with guide surfaces for controlling movement of ammunition rounds within the canister;

plastic sprocket means, comprising a drive sprocket and an idler sprocket, for moving the ammunition rounds within the canister;

a spring housing assembly, rotatably mounted to one of the shells, comprising spring means for applying torque to said drive sprocket, plastic crank means for tensioning said spring means, and plastic rachet means for engaging the outer shell.

2. The ammunition canister according to claim 1 wherein said driver and idler sprockets are identical in size and shape.

3. An ammunition canister comprising:

a pair of plastic outer shells, each said shell configured for assembly with another shell to form an ammunition canister, each said shell being molded with guide surfaces for controlling movement of ammunition rounds within the canister;

plastic sprocket means, comprising a drive sprocket and an idler sprocket for moving the ammunition rounds within the canister;

a spring housing assembly, rotatably mounted to one of said shells, comprising spring means for applying torque to said drive sprocket, plastic crank means for tensioning said spring means, and plastic rachet means for engaging the outer shell; and a plastic non-detachable cover and means enabling permanent assembly with the pair of plastic outer shells, said cover being hinge-mounted to said plastic outer shells and having integrally molded thereinto latch means for engaging the shells in order to lock the cover over an ammunition exit port.

4. The ammunition canister according to claim 3 wherein the shells, sprockets, spring housing and cover are all formed from one type of plastic material.

5. The ammunition canister according to claim 4 further comprising plastic locking pawl means for preventing inadvertent ejection of ammunition rounds when the spring is tensioned and the cover is in an open position.

6. An ammunition canister comprising:

a plastic outer housing, molded from sufficiently translucent plastic material to enable visual verification of a quantity of ammunition rounds disposed in the canister, said plastic outer housing having interior surfaces for controlling movement of ammunition rounds therein;

plastic sprocket means, comprising a drive sprocket and an idler sprocket which are identical in size and shape, for moving the ammunition rounds within the canister;

spring means for applying torque to said drive sprocket;

spring housing means for mounting said spring means to said plastic outer housing; and crank means for tensioning said spring means.

7. An ammunition canister comprising:

a plastic outer housing, molded from a sufficiently translucent plastic material to enable visual verification of a quantity of ammunition rounds disposed in the canister, and said plastic outer housing having interior surfaces for controlling movement of ammunition rounds therein;

plastic sprocket means, comprising a drive sprocket and an idler sprocket, for moving the ammunition rounds within the canister;

spring means for applying torque to said drive sprocket;

plastic spring housing means for mounting said spring means to said plastic outer housing;

crank means for tensioning said spring means; and a plastic non-detachable cover and means enabling permanent assembly with said plastic outer housing, said cover being hinge-mounted to said plastic outer housing and having integrally molded thereinto latch means for engaging said plastic outer housing in order to lock the cover over an ammunition exit port.

8. The ammunition canister according to claim 7 wherein the outer housing, sprockets, spring housing means and cover are all formed from one type of plastic material.

9. The ammunition canister according to claim 8 further comprising plastic locking pawl means for preventing inadvertent ejection of ammunition rounds when the spring means is tensioned and the cover is in an open position.

* * * * *